United States Patent [19]

Suzuki et al.

[11] Patent Number: 4,814,048

[45] Date of Patent: Mar. 21, 1989

[54] PB ALLOY INSOLUBLE ANODE AND CONTINUOUS ELECTROPLATING OF ZINC USING IT

[75] Inventors: Nobukazu Suzuki, Ibaraki; Tadashi Nonaka, Wakayama, both of Japan

[73] Assignee: Sumitomo Metal Industries, Ltd., Osaka, Japan

[21] Appl. No.: 209,881

[22] Filed: Jun. 22, 1988

[30] Foreign Application Priority Data

Jun. 24, 1987 [JP] Japan ..... 62-157196
Jul. 20, 1987 [JP] Japan ..... 62-180868

[51] Int. Cl.[4] ..... C25D 7/06; C25D 17/10
[52] U.S. Cl. ..... 204/28; 204/293
[58] Field of Search ..... 204/28, 293

[56] References Cited

U.S. PATENT DOCUMENTS 3,755,094 8/1973 Seyb ..... 204/293

*Primary Examiner*—T. M. Tufariello
*Attorney, Agent, or Firm*—Burns, Doane, Swecker & Mathis

[57] ABSTRACT

A Pb alloy insoluble anode and continuous electroplating of zinc using the same are disclosed, in which the Pb alloy consists essentially of 0.5–13 weight % of In or 0.5–13 weight % of In and 0.5–10 weight % of Ag and a balance of Pb with incidental impurities in which the amount of Sn is restricted to not more than 0.005% is used as an insoluble anode, and plating is carried out with a current density of at least 50 $A/dm^2$ and a plating solution flow velocity of at least 0.6 m/sec.

14 Claims, 3 Drawing Sheets

PB ALLOY INSOLUBLE ANODE AND CONTINUOUS ELECTROPLATING OF ZINC USING IT

BACKGROUND OF THE INVENTION

This invention relates to a Pb alloy insoluble anode, and particularly to a Pb alloy which exhibits superior durability as an insoluble anode in electroplating using a sulfuric acid-type plating bath and in electrolytic refining using a sulfuric acid-type bath. The Pb alloy insoluble anode is advantageous especially when used as an anode in a high-speed, high current density process.

Therefore, this invention also relates to a continuous method for electroplating steel strip with zinc, and in particular to a continuous method for electroplating of zinc on steel strip in a high-speed line with a high current density, using the above-mentioned Pb alloy insoluble anode.

In general, when employing insoluble electrodes, plating metal is supplied in the form of ions. A plating metal salt is used as a raw material therefor and is usually dissolved in a plating solution and then supplied. For this reason, in order to increase the solubility of the salt, it is common to adjust the pH of the plating bath to a low level (for example, a pH of 1.0–2.0).

The low pH of the plating bath is a cause of corrosion of the discharge surface of insoluble electrodes. Therefore, even if there was no damage due to contact with the strip, the life span of the electrode was extremely short.

For example, even for a Ag-Pb alloy electrode which is said to have a relatively long life span, if zinc plating is carried out in a sulfuric acid bath with a pH of 2.0, the life span of the electrode is a maximum of 6 months.

Thus, in the past, alloys used for electrodes did not have adequate corrosion resistance, so the electrodes had to be frequently replaced.

Many methods for solving this problem have been proposed. For example, Japanese Laid-Open patent application No. 59-28598 discloses that if a small amount of In is added to a Pb(Ag-Pb) alloy for use as an insoluble anode in a sulfuric acid-type plating bath, the dissolution of the surface layer is remarkably decreased.

Namely, under actual plating conditions (bath composition: 250 g/l of $FeSO_4$, 125 g/l of $ZnSO_4$, 75 g/l of $Na_2SO_4$; pH=2, bath temperature=60° C., current density=30–45 A/dm$^2$, material being plated=mild steel sheet, operating time=6 months), the average depth of corrosion was compared for a conventional material (2% Ag-Pb) and materials to which In was added. It was reported that the amount of corrosion was 32% that of the conventional material for a 5% In-Pb alloy and was 6.4% that of the conventional material for a 5% In-2% Ag-Pb alloy.

Similarly, in Japanese Laid-Open patent application No. 59-28599, an example is disclosed in which, instead of In, 0.5–10% of Sn is added to a Pb alloy containing 0.5–5% of Ag. In this case, under similar conditions, the average depth of corrosion decreased to 3% that of a comparative example. This is roughly half the amount of corrosion of a material to which In is added.

In addition, Japanese Laid-Open patent application No. 59-173297 discloses an example of a Pb alloy in which 0.1–3% of Sr is added to 0.5–5% of Ag, and Japanese Laid-Open patent application No. 58-199900 discloses an example of a Pb alloy in which 0.8–6% of Tl is added to 0.3–6% of Ag.

In order to maintain a high line speed so as to increase productivity, the trend in the design of recent electroplating cells is to employ higher current densities. For example, high current density plating at 150 A/dm$^2$ or even 250 A/dm$^2$ with a Ag-Pb alloy electrode has come to be actually performed.

Furthermore, as is apparent from the foregoing, in electrolytes used for electroplating and electrolytic refining, insoluble anodes are used, and electrolysis of Zn, Sn, Ni, Pb, Co, Fe, and Cu or alloys of these materials is performed on the surface of the material to be coated which serves as a cathode. Insoluble anodes made of Pb are commonly used. This is because Pb has corrosion resistance with respect to electroplating baths and electrolytic refining baths. Furthermore, when current is passed through Pb, lead oxide ($PbO_2$) is formed on its surface, and this $PbO_2$ functions as an insoluble anode. However, as Pb is not completely insoluble, when using a Pb insoluble anode, a small quantity of Pb dissolves. Furthermore, the $PbO_2$ which is formed on the surface has poor adhesion to the Pb base, so the $PbO_2$ may peel and does not always exhibit satisfactory durability, i.e., a satisfactory working life. At the same time, the small quantity of $Pb^{2+}$ which dissolves in the electrolyte is electroplated together with $Zn^{2+}$ and the like, and Pb is included in the electroplated film or in the electrolytically refined metal, decreasing the corrosion resistance of the plating or decreasing the purity of the refined metal.

The present inventors disclosed an insoluble anode having superior durability for use in electroplating on the surface of a metal in a sulfuric acid-type electroplating bath (see Japanese Patent No. 1300021, Japanese Published patent application Nos. 60-45719 and 60-45718, and Japanese Laid-Open patent application Nos. 59-173297 and 60-26635).

However, in these conventional insoluble anodes, under the present-day operating conditions employing a high current density such as 50 A/dm$^2$ and even 100 A/dm$^2$ and above, a small amount of Pb dissolves in the electroplating bath, particularly during high-speed plating. This is a main obstacle to performing high-quality electroplating. Moreover, at present there are increasing demands for reductions in production costs. Thus, there is a demand for anodes having a longer life span so as to decrease the length of time between anode replacement, thereby reducing the costs of the anodes themselves and reducing the down-time required for their replacement.

In a type of high current density plating method on a high-speed line, as in the above, the following characteristics are desired.

(i) Prevention of a decrease in the surface layer o insoluble electrodes.

(ii) A decrease in the separation between electrodes.

(iii) Inexpensive electrodes having a long life span.

(iv) An increase in the quality of the plating.

(v) Low power consumption.

These characteristics are all mutually related, but in particular, the higher the current density, the greater is the tendency for the electrode surface layer to decrease. Furthermore, the pH at the electrode interface further decreases ($H_2O \rightarrow 2H^+ + \frac{1}{2}(O_2) + 2e^-$), and the corrosive environment expands. Therefore, in a high-speed zinc electroplating line, a more effective measure to prevent the decrease of the electrode surface layer is needed.

Furthermore, the primary objective of performing high current density plating on a high-speed line is to increase productivity, i.e., output. However, if the current density is increased whereby the line speed is increased, the power consumption is proportional to the square of the current density, so the unit electric power consumption (the electric consumption per unit of production) increases in proportion to the increase in current density or line speed. Therefore, in order to perform high current density operation, a means of further reducing power consumption is necessary.

SUMMARY OF THE INVENTION

Thus, an object of this invention is to provide a stable In-Pb and In-Ag-Pb alloy insoluble anodes which can be used for a longer period of time.

Another object of this invention is to provide a means for increasing the life span of In-Pb alloy insoluble anodes and In-Ag-Pb alloy insoluble anodes which have already been much used on account of their excellent properties.

A still another object of this invention is to provide a continuous method for electroplating of zinc on steel strip, which can prevent a decrease in the electrode surface during plating at a high current density, which is stable over long periods, and which has superior unit power consumption.

In the past, there has been an interest in Pb alloy electrodes such as Ag-Pb alloys which have been much used in sulfuric acid-type baths (including a maximum of 500 ppm of $Cl^-$), and various improvements have been made in this material which is suitable for high current density plating. This is because lead oxide ($PbO_2$) which is formed on the electrode surface functions as an insoluble electrode. However, when performing high current density plating, it has become clear that a Pb alloy electrode suffers from peeling of such electrode surface layer oxides.

The decrease in the surface layer of electrodes which has been a problem in the past is thought to be caused by a combination of two phenomena. One is that the electrode itself dissolves into the plating bath, and the other is that the oxides on the electrode surface layer peel off. Clearly, these phenomena, and particularly the peeling of the electrode surface layer decrease the life span of the electrode and at the same time decrease the plating quality, and a solution to these problems is desired.

The peeling off of the electrode surface layer due to shorting of the electrodes occurs to a greater extent in high-speed plating with a high current density. This not only produces flaws in the plating surface but leads to the formation of indentations during subsequent rolling and causes a decrease in the plating quality.

It is conceivable to employ a Pb alloy in which Ca, Sr, Sn, Tl, or In are incorporated together with Ag. However, when such a Pb alloy electrode is used in high current density plating, the quality of the plating is improved only to some extent, and the peeling resistance of the surface is not adequate. Furthermore, depending on the fluid flow velocity, the method of blowing the fluid, and the distance between electrodes, the plating voltage can be exceedingly high and the capacity of the rectifier for plating current may be exceeded.

Furthermore, at present, in order to maintain productivity, or in order to decrease the unit power consumption, plating is performed with as small an electrode separation as possible, even if some electrode shorts take place. Accordingly, in high-speed, high current density plating, it is necessary to simultaneously satisfy the mutually opposite objectives of lowering the plating voltage and preventing the peeling of the electrode surface.

The present inventors performed various investigations aimed at extending the life span of insoluble anodes used in sulfuric acid-type electroplating baths and sulfuric acid-type electrolytic refining baths. As a result, it was found that of the unavoidable impurities including Sn, Sb, Cu, Zn, Fe and As which are included in Pb, if the concentration of Sn is restricted to a very limited level, the life span of a Pb-In or a Pb-Ag-In alloy insoluble anode can be greatly lengthened, and at the same time the durability thereof is remarkably increased.

It was also unexpectedly found that rather than an Sn-containing material which was thought to be suitable for low current densities, In-Pb and In-Ag-Pb alLoy electrodes in which the concentration of Sn as an impurity is restricted to a very low level are particularly effective for use in high-speed continuous plating.

Accordingly, this invention is a Pb alloy insoluble electrode of the Pb-In type or the Pb-Ag-In type in which the total amount of Sn as an impurity is restricted to at most 0.005%.

An example of the above-mentioned Pb-In anode is a Pb alloy comprising, in weight %, 0.5–13% of In and a balance of Pb with incidental impurities. An example of a Pb-Ag-In anode is a Pb alloy comprising, in weight %, 0.5–13% of In, 0.5–10% of Ag, and a balance of Pb with incidental impurities.

The unavoidable impurities which are contained in the Pb are those which originate in the raw materials for Pb. The raw materials for Pb and the refining process therefor are as follows.

Lead occurs alone in the form of galena (PbS), cerussite ($PbCO_3$), anglesite ($PbSO_4$), crocoisite ($PbCrO_4$), or as a complicated mineral together with zinc, silver and copper ores, and the like. In lead refining, these lead ores are used as a raw material and sintering is performed two times in a sintering oven to remove harmful sulfur. Then, sintered lumps, fuel coke, limestone as a flux, and scrap steel are charged into a blast furnace and refining is carried out. The resulting crude lead is refined using the Betts method, which is an electrolysis method, or else the Parkes method or the Harris method, which are dry methods. The purity of the refined lead is at least 99.9% for industrial use and at least 9.99% for electrical lead.

However, in the above-described refining method, the content of incidental impurities such as Sn, Sb, Cu, Zn, Fe, and As is generally 0.1–0.01 weight %, and in the past, discussion of the durability of Pb alloys assumed an impurity content of this order.

Upon investigating the effects of the above-mentioned unavoidable impurities, it was found that if the content of Sn exceeds 0.005 weight %, the durability is enormously decreased, and on the basis of this discovery, this invention was achieved. In the past, the content of Sn as an incidental impurity was generally about 0.05 weight %.

Therefore, more specifically, this invention is a Pb alloy insoluble anode comprising, in weight %, 0.5–13 weight of In, optionally 0.5–10 % of Ag, and a remainder of Pb with incidental impurities, of the impurities the content of Sn being at most 0.005%.

In another aspect, the present invention is a continuous method for electroplating of zinc on steel strip, which uses a sulfuric acid-type zinc electroplating bath, which uses a Pb alloy insoluble electrode containing 0.5–13 weight % of In or 0.5–13 weight % of In and 0.5–10 weight % of Ag and a balance of Pb with incidental impurities, of the impurities the content of Sn being not more than 0.005 %, and which performs plating with a current density of at least 50 $A/dm^2$ and preferably at least 75 or 80 $A/dm^2$ and a plating solution flow rate of at least 0.6 m/sec and preferably at least 1.0 m/sec.

The effects of this invention are particularly striking when high current density plating is performed with a current density of 80 $A/dm^2$ or greater.

In a preferred mode of this invention, the above-mentioned electrolytic zinc plating is pure zinc, Ni-Zn, Fe-Zn, or Mn-Zn plating.

The above-described plating solution flow speed is the absolute flow velocity of the plating solution between the electrodes. There is no particular upper limit thereon, but under normal conditions, it is at most 2.0 m/sec.

There is no single method of introducing the plating solution in order to maintain a flow velocity of at least 0.6 m/sec. However, from the standpoint of improving the electroplating conditions, it is preferable to employ nozzles which spray plating solution in the opposite direction to the direction of movement of the strips.

The method of this invention is intended for continuous electroplating of zinc on steel strip. The speed of the strips is preferably 0.33–3.33 m/sec.

DESCRIPTION OF THE PREFERRED EMBODIMENTS

Hereinbelow, the reasons for the above-mentioned restrictions on the component proportions will be explained. In the following explanation, unless otherwise indicated, % means weight %.

By alloying with Pb, In increases the resistance to dissolution. Particularly when the Sn content is restricted to at most 0.005%, the addition of less than 0.5 % of In has no effect. On the other hand, if the amount which is employed exceeds 13%, the alloy becomes expensive and its workability deteriorates. Therefore, in this invention, the In content is restricted to 0.5–13% and preferably 2–8%.

As for Ag, when the Sn content is restricted to at most 0.005%, the above-described effect of In can be greatly improved if the Ag content is in the range of 0.5–10%.

Sn is present in the form of an incidental impurity. As explained above, when it is present in an amount of greater than 0.005%, the durability of the alloy enormously decreases.

In this manner, in this invention, the effect of decreasing dissolution of Pb alloy into an electrolyte for which In is known is particularly excellent when the content of Sn is restricted to at most 0.005%, and an unexpected synergistic effect is achieved for a Pb alloy containing In.

If high-purity Pb obtained by the Betts method is employed, the content of Sn as an impurity can be easily limited to at most 0.005%. In this case, the total of the other impurities is also at most 0.005%. Furthermore, if refined Pb which does not contain bismuth as an impurity is used, Sn can be removed from the refined Pb by oxidizing while stirring at the time of melting.

Figure 1:
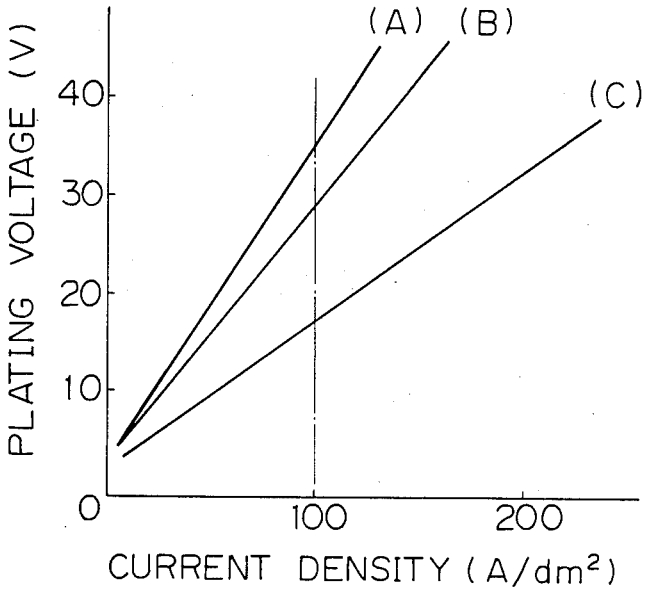
FIG. 1 is a graph showing the relationship between the current density and the plating voltage for this invention.

By the way, a general relationship between the plating voltage and the plating current each for a conventional alloy electrode and for an alloy electrode of this invention is shown in FIG. 1.

In this graph, Curve A shows the case for a conventional example (Pt electrode) with an electrode separation d=30mm. By instead using an Ag-Pb alloy electrode and raising the plating solution flow velocity from 0.2 to 0.9 m/sec, gas removal is increased, and as a result, the plating potential is reduced (Curve B). The electrode distance d=30mm. Furthermore, by using an In-Ag-Pb alloy electrode ($Sn \leqq 0.005\%$) of this invention and reducing the electrode separation by half, the plating voltage is even further decreased. When the electrode distance d=15mm and the current density A=100 $A/dm^2$, the plating voltage is roughly halved (Curve C). This tendency is particularly remarkable with a current density of at least 100 $A/dm^2$. In the past, the electrode separation could not be less than 30mm, and even when using the conventional Pb electrode, the separation could not be less than 20mm.

In this manner, according to this invention, the excellent current efficiency of continuous high-speed electroplating is even further improved.

This invention will be further explained by means of examples, which are presented merely for illustrative purposes and are not restrictive in any way to this invention.

EXAMPLE 1

Pb from which Sn had been removed by the Betts method was employed. Prescribed amounts of In and Sn were added thereto and the mixture was used as a starting material. Pb alloy melts having the compositions shown in Table 1 were prepared by a usual melting method. The melts were then cast and rolled to obtain plates with a thickness of 1 mm. Test pieces measuring 1 mm thick by 30 mm wide×100 mm long were then cut from the plates and used as anodes. A piece of Pt plate having the same dimensions was used as a cathode. Both electrodes were immersed into a bath of an aqueous sodium sulfate solution acidified with sulfuric acid in which were dissolved 100g/l of $Na_2SO_4$ (pH of bath: 2). At a bath temperature of 70° C. and an applied current of 10A (current density: 80$A/dm^2$), electroplating was performed for 500 hours. Afterwards, the oxide film which was formed on the surface of the test piece was removed in an aqueous solution in which were dissolved 160 g/l of NaOH and 200 g/l of glycose. The weight loss of the test piece per unit of electricity was then measured.

The results of measurements are also shown in Table 1.

Figure 2:
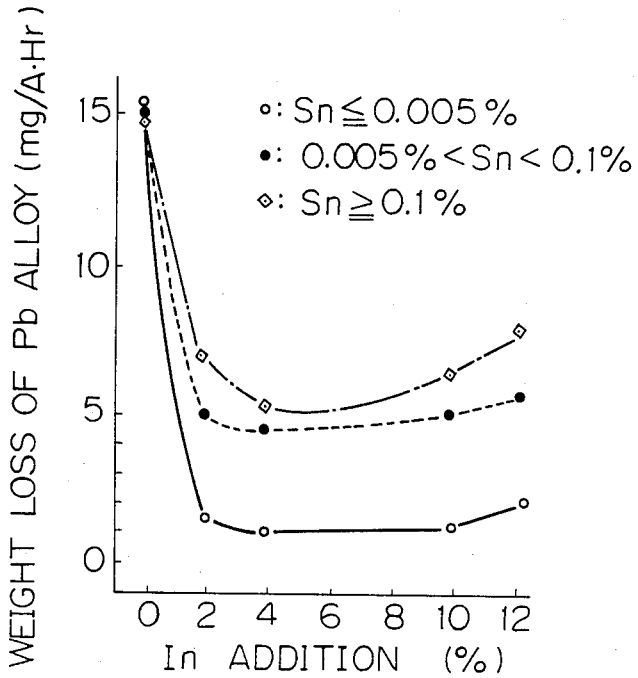
FIG. 2 is a graph showing the effect of the addition of In when the Sn content is restricted to various levels.
Figure 3:
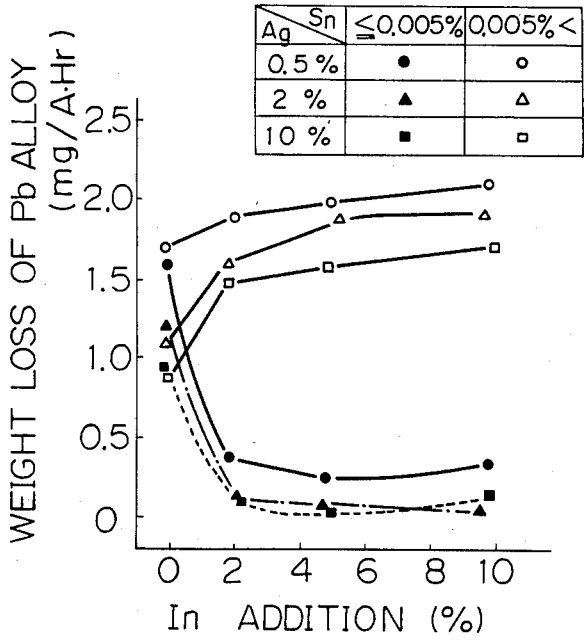
FIG. 3 is a graph showing the effect of the addition of Ag and In when the Sn content is greater than 0.005% or not greater than 0.005%.
Figure 4:
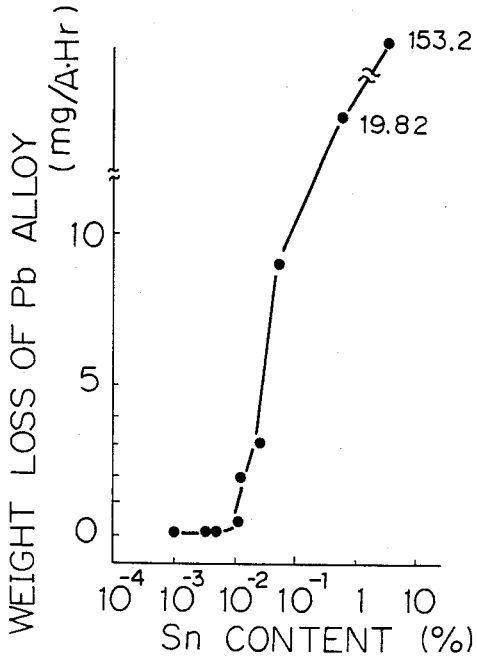
FIG. 4 is a graph showing the effect of the Sn content in a 2% Ag-5% In Pb alloy.

FIG. 2 shows the relationship the content of In and Sn to the weight loss of the test piece. FIG. 3 shows the relationship of the content of In, Ag, and Sn to the weight loss of the test piece. FIG. 4 shows the relationship of the Sn content of a test piece containing 5% In and 2% Ag to the weight loss of the test piece.

As is clear from Table 1 and FIGS. 2–4, if the Sn content is restricted to at most 0.005%, the weight loss is extremely small in both a 0.5–13% Pb alloy or a 0.5–13% In-0.5–10% Ag-Pb alloy. Preferably, the Sn content is 0.003% or less.

In particular, it can be seen from FIG. 2 that when the In content is in the range of 2–12%, due to a synergistic effect with Sn decrease, excellent resistance to dissolution is achieved. From FIG. 3, it can be seen that regardless of the amount of Ag, if the Sn content is restricted to at most 0.005%, an excellent synergistic effect with the addition of In is achieved. Furthermore, from FIG. 4, it can be seen that by restricting the Sn content to at most 0.005%, the resulting alloy is made essentially insoluble.

In the test pieces, the total content of Sb, Cu, Zn, Fe, As, and the like as impurities was at most 0.001%.

TABLE 1

| | Alloy Composition (weight %) | | | | Weight Loss | |
|---|---|---|---|---|---|---|
| No. | In | Ag | Sn | Pb | (mg/A-hr) | Comments |
| 1 | — | — | 0.004 | bal. | 15.4 | |
| 2 | — | — | 0.010 | " | 15.0 | |
| 3 | — | — | 0.121 | " | 14.8 | |
| 4 | 2.0 | — | 0.005 | " | 1.5 | O |
| 5 | 2.1 | — | 0.051 | " | 5.0 | |
| 6 | 2.0 | — | 0.11 | " | 6.9 | |
| 7 | 4.9 | — | 0.002 | " | 1.1 | O |
| 8 | 4.8 | — | 0.044 | " | 4.5 | |
| 9 | 5.0 | — | 0.21 | " | 5.2 | |
| 10 | 9.9 | — | 0.004 | " | 1.2 | O |
| 11 | 10.0 | — | 0.069 | " | 5.0 | |
| 12 | 9.8 | — | 0.13 | " | 6.3 | |
| 13 | 12.3 | — | 0.004 | " | 2.0 | O |
| 14 | 12.2 | — | 0.025 | " | 5.5 | |
| 15 | 12.2 | — | 0.37 | " | 7.7 | |
| 16 | — | 0.52 | 0.026 | " | 1.7 | |
| 17 | 2.1 | 0.49 | 0.031 | " | 1.9 | |
| 18 | 5.0 | 0.48 | 0.024 | " | 2.0 | |
| 19 | 9.9 | 0.50 | 0.039 | " | 2.1 | |
| 20 | — | 0.51 | 0.002 | " | 1.6 | |
| 21 | 1.9 | 0.50 | 0.005 | " | 0.39 | O |
| 22 | 4.8 | 0.51 | 0.003 | " | 0.25 | O |
| 23 | 9.7 | 0.49 | 0.001 | " | 0.40 | O |
| 24 | — | 2.13 | 0.033 | " | 1.1 | |
| 25 | 1.8 | 2.07 | 0.016 | " | 1.6 | |
| 26 | 5.2 | 1.94 | 0.012 | " | 1.9 | |
| 27 | 9.7 | 2.05 | 0.039 | " | 0.92 | |
| 28 | — | 1.96 | 0.007 | " | 1.2 | |
| 29 | 2.1 | 1.89 | 0.002 | " | 0.14 | O |
| 30 | 4.7 | 2.14 | 0.001 | " | 0.08 | O |
| 31 | 9.5 | 2.02 | 0.005 | " | 0.26 | O |
| 32 | — | 9.93 | 0.072 | " | 0.96 | |
| 33 | 1.9 | 9.85 | 0.044 | " | 1.52 | |
| 34 | 4.9 | 9.58 | 0.059 | " | 1.59 | |
| 35 | 10.0 | 9.77 | 0.027 | " | 1.70 | |
| 36 | — | 9.91 | 0.001 | " | 0.90 | |
| 37 | 2.2 | 10.06 | 0.001 | " | 0.10 | O |
| 38 | 5.0 | 9.65 | 0.002 | " | 0.03 | O |
| 39 | 9.8 | 9.74 | 0.001 | " | 0.14 | O |
| 40 | 4.9 | 1.98 | 0.003 | " | 0.07 | O |
| 41 | 4.8 | 1.89 | 0.005 | " | 0.13 | O |
| 42 | 5.1 | 1.92 | 0.010 | " | 0.46 | |
| 43 | 5.0 | 2.10 | 0.023 | " | 3.10 | |
| 44 | 4.9 | 1.86 | 0.051 | " | 9.08 | |
| 45 | 5.0 | 1.93 | 0.33 | " | 19.82 | |

TABLE 1-continued

| | Alloy Composition (weight %) | | | | Weight Loss | |
|---|---|---|---|---|---|---|
| No. | In | Ag | Sn | Pb | (mg/A-hr) | Comments |
| 46 | 5.0 | 1.99 | 3.1 | " | 153.2 | |

(Note)
O: This Invention

EXAMPLE 2

In this example, an ordinary horizontal zinc electroplating cell was employed as an electroplating device. As an example of this invention, an insoluble electrode made from a 5% In-2% Ag-Pb alloy in which the amount of Sn in impurities was 0.001% was employed, a 5% Sn-2% Ag-Pb alloy electrode was used as a comparative example, and a 2% Ag-Pb alloy electrode was used as a conventional example. The electrodes were manufactured by padding the above alloys to a thickness of 10 mm on carbon steel sheet. The electrode measured 1900 mm wide×500 mm long. At this time, the plating bath composition was 250 g/l of $FeSO_4$, 125 g/l of $ZnSO_4$, and 75 g/l of $Na_2SO_4$. The pH was 2 and the bath temperature was 60° C. This solution was blown in the opposite direction of mild steel sheet at a constant flow rate of 1.2 m/sec, and continuous high-speed plating was performed. The electrode separation was 15 mm and the strip speed was 2.5 m/sec. For the conventional example and the comparative example, the plating solution flow rate was 0.2 m/sec.

The current density was varied and the effect on the amount of weight loss of the electrodes was investigated. The results are shown in graphical form in FIG. 5. In the figure, curve (a) is for the conventional example, curve (b) is for the comparative example, and curve (c) is for the example of this invention.

The maximum current density "id" is approximated by the following equation, based on the electrode length l, the electrode separation d, and the fluid velocity v between the electrodes.

$$id = k(v/ld)^{\frac{1}{2}} \text{ (k=a constant)}$$

Figure 5:
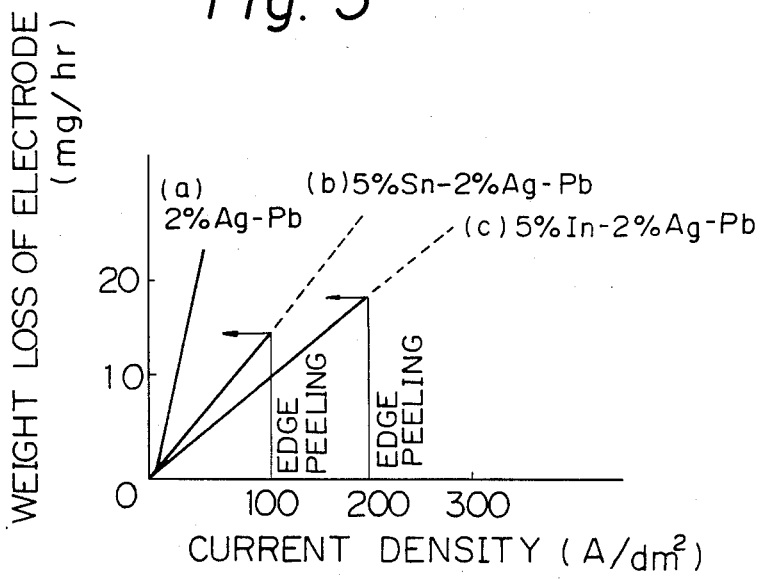
FIG. 5 is a graph showing the relationship between the current density and the weight loss of electrode.

As a measure of performance in actual operation, the peeling of the plating in the edge portion of the strip was measured (the plating in the edge portion peels as a forerunner of burning due to current concentration). As shown in FIG. 5, for the comparative example using a 5% Sn-2% Ag-Pb alloy electrode with a flow velocity of 0.2 m/sec, edge peeling began at a current density of 100 A/dm$^2$. In contrast, when using a 5% In-2% Ag-Pb alloy (Sn≦0.005%) electrode with a higher flow velocity of 1.2 m/sec, the current density at which edge peeling occurs is approximately doubled to 200 A/dm$^2$. Namely, the conditions under which stable operation can be performed are expanded by that amount.

When the flow velocity was increased to 1.2 m/sec for the comparative example, i.e., the 5% Sn-2% Ag-Pb alloy electrode, this improvement was not observed.

EXAMPLE 3

The procedure of Example 2 was repeated using various conventional Pb alloy electrodes. The current density was 80 A/dm$^2$ (average). The resistance of the electrodes to surface layer peeling was evaluated based on the electrode life span under actual operating conditions and on the weight decrease in a laboratory.

The plating conditions were the same for all of the alloy electrodes.

The results are shown in the following Table 2. It can be seen that an electrode material containing In with Sn being less than 0.005% had particularly remarkable effects.

The life span in this table was the period of continuous use (the number of months) until the deterioration of the quality of the product due to peeling of the electrode surface layer and the like could no longer be ignored. The weight decrease was the weight decrease of an anode when a continuous conducting immersion test was performed in a laboratory. This weight loss is not a cause of a decrease in product quality, and therefore a low test value does not necessarily indicate a low weight loss under actual operating cnditions.

TABLE 2

| No. | Alloy Composition | Life Span* (Months) | Weight Loss** (mg/A-hr) |
|---|---|---|---|
| 1 | 5% In-2% Ag—Pb*** | 24 | 0.4 |
| 2 | 5% Sn-2% Ag—Pb | 12 | 0.5 |
| 3 | 3% Ca-2% Ag—Pb | 6 | 1.4 |
| 4 | 2% Ag—Pb | 6 | 1.3 |
| 5 | 5% Sn—Pb | 3 | 3.5 |

(Notes)
*Life span under actual operation conditions
**Laboratory data on weight loss
***The amount of Sn was 0.001%.

For a 5% Sn-Pb alloy electrode the life span was 3 months, for a 2% Ag-Pb alloy electrode it was 6 months, and for a 5% In-2% Ag-Pb alloy electrode in which the amount of Sn was 0.001% it was 24 months, showing the great superiority of an electrode material of this invention. This is thought to be because, of the oxides (PbO, $PbO_2$) in the surface layer of the electrode, the proportion of $PbO_2$ which has good corrosion resistance is high. A decrease in operating costs and maintenance costs can be expected from such an increase in life span.

When performing high-speed high current density plating with an Sn-containing material, which exhibits excellent effects in a low-current region, rather than surface layer peeling, surface layer dissolution is prominent. This is thought to be because in the case of an Sn-containing material, the ability to form $PbO_2$ which promotes high corrosion resistance in a Pb surface layer is inferior to that of an Ag-containing material, and the Pb alloy is dissolved out before the formation of a passive film can be completed.

Accordingly, since it was thought that an Sn-containing alloy can exhibit excellent resistance to corrosion in a low-current region, the above-described effect of the addition of In is unexpected.

Furthermore, as for the effect on plating quality, in accordance with this invention, the peeling of surface layer oxides is greatly suppressed, as evidenced by the lengthened life span as described above.

EXAMPLE 4

In this example, the procedure of Example 2 was repeated, and the relationship between the flow velocity of the plating solution and the plating voltage was investigated using a 5% In-2% Ag-Pb electrode.

Figure 6:
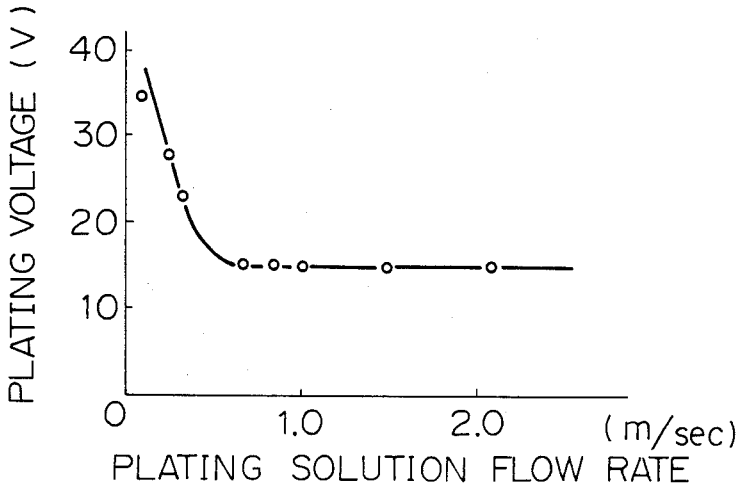
FIG. 6 is a graph showing the change in the plating voltage when the plating solution flow rate was changed.

The results are graphed in FIG. 6. It can be seen that with a current density of 80 A/dm$^2$, the plating voltage rises when the plating solution flow velocity is less than 0.6 m/sec. Namely, if the plating solution flow velocity is at least 0.6 m/sec, a further decrease in the plating voltage, i.e., a further improvement in the unit power consumption can be expected.

We claim:

1. A Pb alloy insoluble anode which consists essentially of, in weight %, 0.5–13% of In and a balance of Pb with incidental impurities, the amount of Sn in the incidental impurities being not more than 0.005%.

2. A Pb alloy insoluble anode as defined in claim 1, wherein the In content is 2–8%.

3. A Pb alloy insoluble anode as defined in claim 1, wherein the amount of Sn is not more than 0.003%.

4. A Pb alloy insoluble anode which consists essentially of, in weight %, 0.5–13% of In, 0.5–10% of Ag, and a balance of Pb with incidental impurities, the amount of Sn in the incidental impurities being not more than 0.005%.

5. A Pb alloy insoluble anode as defined in claim 4, wherein the In content is 2–8%.

6. A Pb alloy insoluble anode as defined in claim 4, wherein the amount of Sn is not more than 0.003%.

7. A method of expanding the life span of an In-Pb or In-Ag-Pb alloy insoluble anode for use in continuously electroplating steel strip with zinc by restricting the amount of Sn in incidental impurities to not more than 0.005% by weight.

8. A method as defined in claim 7, wherein the In-Pb alloy consists essentially of, in weight %, 0.5–13% of In and a balance of Pb with incidental impurities.

9. A method as defined in claim 7, wherein the In-Ag-Pb alloy consists essentially of, in weight %, 0.5–13% of In, 0.5–10% of Ag, and a balance of Pb with incidental impurities.

10. A method as defined in claim 7, wherein the amount of Sn is restricting to not more than 0.003% by weight.

11. A continuous method for electroplating of zinc wherein a sulfuric acid-type zinc electroplating bath is used, a lead alloy electrode consisting essentially of 0.5–13 weight % of In or 0.5–13 weight % of In and 0.5–10 weight of Ag and a balance of Pb with incidental impurities in which the amount of Sn is restricted to not more than 0.005% is used as an insoluble anode, and plating is carried out with a current density of at least 50 A/dm$^2$ and a plating solution flow velocity of at least 0.6 m/sec.

12. A continuous method for electroplating of zinc as defined in claim 11, wherein plating of pure zinc, Ni-Zn, Fe-Zn, or Mn-Zn is performed.

13. A continuous method for electroplating of zinc as defined in claim 11, wherein the current density is greater than 80 A/dm$^2$.

14. A continuous method for electroplating of zinc as defined in claim 11, wherein the strip velocity is 0.33–3.33 m/sec.

* * * * *